United States Patent [19]

VanRens

[11] Patent Number: 4,690,201

[45] Date of Patent: Sep. 1, 1987

[54] LOST FOAM MOLD PATTERN AND ASSOCIATED METHOD

[75] Inventor: Russell J. VanRens, West Allis, Wis.

[73] Assignee: Outboard Marine Corporation, Waukegan, Ill.

[21] Appl. No.: 747,262

[22] Filed: Jun. 21, 1985

[51] Int. Cl.[4] ..... B22C 7/02; B22C 9/04

[52] U.S. Cl. ..... 164/516; 164/34; 164/235; 164/246; 164/249

[58] Field of Search ..... 164/34, 35, 36, 235, 164/246, 249, 516–519

[56] References Cited

U.S. PATENT DOCUMENTS

| | | | |
|---|---|---|---|
| 2,731,668 | 1/1956 | Miner | 425/272 |
| 2,755,205 | 7/1956 | Robb et al. | 427/235 |
| 2,793,412 | 5/1957 | Lashbrook | 164/34 |
| 3,278,998 | 10/1966 | Tingquist et al. | 164/166 |
| 3,362,463 | 1/1968 | Manginelli | 164/34 |
| 3,468,364 | 9/1969 | Rusk et al. | 164/235 |
| 4,240,492 | 12/1980 | Edwards et al. | 164/34 |
| 4,396,054 | 8/1983 | Cole | 164/34 |

FOREIGN PATENT DOCUMENTS

| | | | |
|---|---|---|---|
| 933304 | 8/1963 | United Kingdom | 164/36 |

*Primary Examiner*—J. Reed Batten, Jr.

*Attorney, Agent, or Firm*—Michael, Best & Friedrich

[57] ABSTRACT

A foam mold pattern assembly comprising a pattern having opposite first and second ends, a first projection connected to the pattern for facilitating suspension of the foam mold pattern assembly with the first end facing generally upwardly, and a second projection connected to the pattern for facilitating suspension of the foam mold pattern assembly with the second end facing generally upwardly.

10 Claims, 3 Drawing Figures

LOST FOAM MOLD PATTERN AND ASSOCIATED METHOD

BACKGROUND OF THE INVENTION

The invention relates to the lost foam process for metal casting, and more particularly to foam pattern assemblies used in the lost foam casting process and to the preparation of foam pattern assemblies for casting.

The lost foam casting process typically includes the steps of dipping a foam pattern or pattern cluster in a refractory coating with the sprue extending upwardly, and drying the pattern by hanging it by the sprue. This can present a problem if the pattern has a pocket which opens upwardly when the sprue extends upwardly, since, even if the pattern is turned upside down to empty the pocket, some refractory coating will collect in the bottom of the pocket when the pattern is turned rightside up for drying. This results in an unnecessarily thick coating which is more difficult to dry and which can cause casting defects.

Attention is directed to the following U.S. patents:

| | | |
|---|---|---|
| Miner | 2,731,668 | Jan. 24, 1956 |
| Robb et al. | 2,755,205 | July 17, 1956 |
| Tingquist et al. | 3,278,998 | Oct. 18, 1966 |
| Edwards et al. | 4,240,492 | Dec. 23, 1980 |
| Cole | 4,396,054 | Aug. 2, 1983 |

SUMMARY OF THE INVENTION

The invention provides a foam mold pattern assembly comprising a pattern having opposite first and second ends, first means connected to the pattern for facilitating suspension of the foam mold pattern assembly with the first end facing generally upwardly, and second means connected to the pattern for facilitating suspension of the foam mold pattern assembly with the second end facing generally upwardly.

In one embodiment, the first means includes a first projection connected to the pattern and extending therefrom in one direction, the first projection being engageable by means for suspending the foam mold pattern assembly, and the second means includes a second projection connected to the pattern and extending therefrom in a direction generally opposite the one direction, the second projection being engageable by means for suspending the foam mold pattern assembly.

In one embodiment, the second projection is removably connected to the pattern.

In one embodiment, the first projection includes a sprue having an end connected to the pattern, and the second projection includes a false sprue connected to the end of the sprue.

In one embodiment, the false sprue is removably connected to the end of the sprue.

The invention also provides a method for preparing a foam mold pattern for casting in a lost foam casting process, the method comprising the steps of providing a foam mold pattern assembly including a pattern, a first projection connected to the pattern and extending therefrom in one direction, and a second projection connected to the pattern and extending therefrom in a direction generally opposite the one direction, providing a container of refractory coating, dipping the foam mold pattern assembly into the container of refractory coating with the first projection extending upwardly, drying the foam mold pattern assembly by suspending the foam mold pattern assembly by the second projection, and removing the second projection from the pattern.

A principal feature of the invention is the provision of a foam mold pattern assembly comprising a pattern having opposite first and second ends, first means connected to the pattern for facilitating suspension of the assembly with the first end facing generally upwardly, and second means connected to the pattern for facilitating suspension of the assembly with the second end facing generally upwardly. This allows the pattern assembly to be turned upside down for drying so that refractory coating does not collect in pockets in the pattern.

Another principal feature of the invention is the provision of a foam mold pattern assembly comprising a pattern, a sprue connected to the pattern and extending therefrom in one direction, and a false sprue removably connected to the pattern and extending therefrom in a direction generally opposite the one direction. This allows the pattern assembly to be dried upside down, and the false sprue can be removed before casting in order to avoid waste of metal.

Another principal feature of the invention is the provision of a method for preparing the foam mold pattern assembly for casting in a lost foam casting process, the method comprising the steps of providing a foam mold pattern assembly as described above, providing a container of refractory coating, dipping the foam mold pattern assembly into the container of refractory coating with the sprue extending upwardly, drying the foam mold pattern assembly by suspending it by the false sprue, and removing the false sprue from the pattern portion.

Other principal features and advantages of the invention will become apparent to those skilled in the art upon review of the following detailed description, claims, and drawings.

Figures 1, 2, 3:
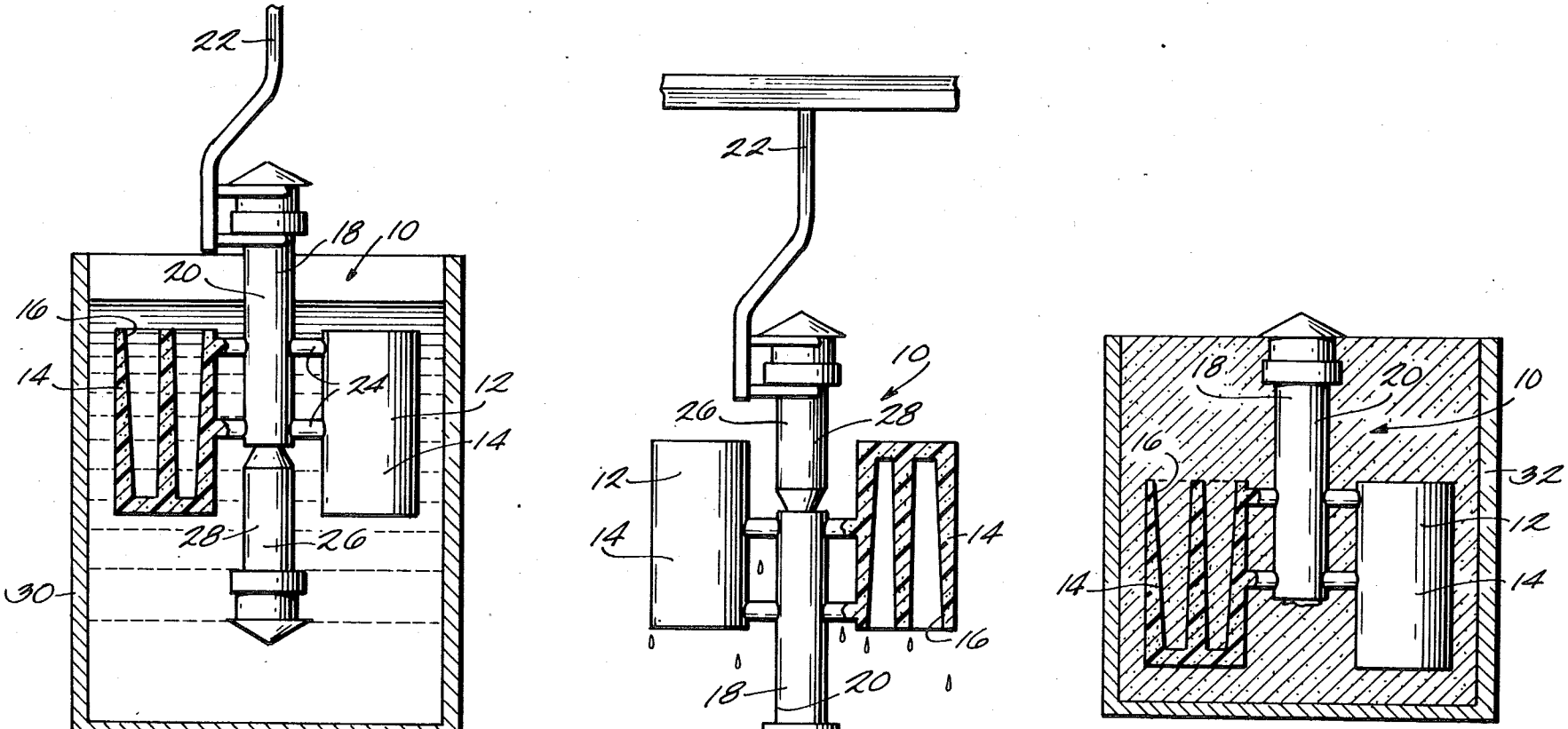
FIG. 1 is a side elevational view, partially cut away, of a foam mold pattern assembly embodying the invention and being dipped in a container of refractory coating.
FIG. 2 is a side elevational view of the assembly hung upside down for drying.
FIG. 3 is a side elevational view of the assembly, with the false sprue removed, surrounded by sand in a mold flask.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

The method of the invention and a foam mold pattern assembly 10 embodying the invention are illustrated in the drawings.

As best shown in FIG. 1, the foam mold pattern assembly 10 comprises a pattern 12 having opposite first and second or upper and lower ends. In the preferred embodiment, tne pattern 12 includes a cluster of pattern portions 14. Preferably, each of the pattern portions 14 includes a pocket or pockets 16 opening upwardly.

The assembly 10 also comprises first means connected to the pattern 12 for facilitating suspension of the assembly 10 with the upper end facing generally upwardly, as shown in FIG. 1. While various suitable first means can be employed, in the preferred embodiment, the first means includes a first projection 18 connected to the pattern 12 and extending therefrom in one direction (upwardly in FIG. 1), the first projection 18 being engageable by means for suspending the assembly. Preferably, the first projection 18 includes a conventional sprue 20 having a lower end connected to the pattern 12, and an upper end adapted to be engaged by conveyor means 22 (FIG. 2). In the illustrated construction, the lower end of the sprue 20 is connected to the pattern portions 14 by gates 24 (FIG. 1).

The assembly 10 also comprises second means connected to the pattern 12 for facilitating suspension of the assembly 10 with the lower end facing upwardly, as shown in FIG. 2. While various suitable second means can be employed, in the preferred embodiment, the second means includes a second projection 26 connected to the pattern 12 and extending therefrom in a direction generally opposite the above-mentioned one direction (downwardly in FIG. 1), the second projection 26 also being engageable by means such as the conveyor means 22 for suspending the assembly 10. Preferably, the second projection 26 includes a false sprue 28 removably connected to the lower end of the sprue 20.

The method of the invention is illustrated in FIGS. 1 through 3. Preferably, the assembly 10 is carried between stations by the conveyor means 22. The method comprises the steps of providing a foam mold pattern assembly 10, providing a container of refractory coating 30, and dipping the assembly 10 into the container of refractory coating 30 with the sprue 20 extending upwardly, as shown in FIG. 1. Any suitable means or apparatus can be used for dipping the assembly 10. For an example of a suitable apparatus, see copending Bailey U.S. patent application Ser. No. 699,485, filed Feb. 7, 1985 and now U.S. Pat. No. 4,572,850 issued Feb. 25, 1986.

The method preferably also comprises the step of turning the assembly 10 upside down to empty the pockets 16 into the container of refractory coating 30. This can be done either manually or automatically by the dipping apparatus (not shown).

The method also comprises the step of drying the assembly 10 by suspending it by the false sprue 28, as shown in FIG. 2. Preferably, the assembly 10 is manually removed from the dipping apparatus and is suspended upside down on the conveyor means 22. If desired, the assembly 10 can be conveyed upside down through a drying oven (not shown) for faster drying.

The method further comprises the step of removing the false sprue 28 from the pattern 12, as shown in FIG. 3. The assembly 10 is shown in FIG. 3 surrounded by sand in a mold flask 32 and ready for casting.

Other features and advantages of the invention are set forth in the following claims.

I claim:

1. A foam mold pattern assembly comprising a pattern having opposite first and second ends and including a blind pocket open in one direction, first means connected to said pattern for facilitating suspension of said foam mold pattern assembly with said first end facing generally upwardly, second means for facilitating suspension of said foam mold pattern assembly with said second end facing generally upwardly, and means connecting said second means to one of said first means and said pattern for facilitating separation of said second means from said one of first means and said pattern.

2. A foam mold pattern assembly as set forth in claim 1 wherein said first means includes a first projection connected to said pattern and extending therefrom in said one direction, said first projection being engageable by means for suspending said foam mold pattern assembly, and wherein said second means includes a second projection connected to said pattern and extending therefrom in a direction generally opposite said one direction, said second projection being engageable by means for suspending said foam mold pattern assembly.

3. A foam mold pattern assembly as set forth in claim 2 wherein said first projection includes a sprue having an end connected to said pattern, and wherein said second projection includes a false sprue connected to said end of said sprue.

4. A foam mold pattern assembly comprising a pattern including a blind pocket open in one direction, a sprue connected to said pattern and extending therefrom in said one direction, a false sprue extending from one of said sprue and said pattern in a direction generally opposite said one direction, and means connecting said false sprue to said one of said sprue and said pattern for facilitating separation of said false sprue from said one of said sprue and said pattern.

5. A foam mold pattern assembly as set forth in claim 4 wherein said sprue has an end connected to said pattern, and wherein said false sprue is connected to said end of said sprue.

6. A foam mold pattern assembly as set forth in claim 4 wherein said pattern includes a cluster of pattern portions connected to said sprue.

7. A foam mold pattern assembly comprising a pattern portion including a blind pocket open in one direction, a sprue portion connected to said pattern portion and extending in said one direction, and a projecting portion connected to one of said pattern portion and said sprue portion and extending in a direction opposite said one direction.

8. A foam mold pattern in accordance with claim 7 wherein said projecting portion is removably connected to said one of said pattern portion and said sprue portion.

9. A foam mold pattern assembly in accordance with claim 8 wherein said projecting portion is connected to an end of said sprue portion.

10. A method for preparing a foam mold pattern for casting in a lost foam casting process, said method comprising the steps of providing a foam mold pattern assembly including a pattern, a first projection connected to said pattern and extending therefrom in one direction, and a second projection connected to said pattern and extending therefrom in a direction generally opposite said one direction, providing a container of refractory coating, dipping said foam mold pattern assembly into said container of refractory coating with said first projection extending upwardly, drying said foam mold pattern assembly by suspending said foam mold pattern assembly by said second projection, and removing said second projection from said pattern.

* * * * *